US007895979B2

(12) United States Patent
Lancefield et al.

(10) Patent No.: US 7,895,979 B2
(45) Date of Patent: Mar. 1, 2011

(54) VALVE MECHANISM FOR AN ENGINE

(75) Inventors: Timothy Mark Lancefield, Shipston On Stour (GB); Ian Methley, Witney (GB); Nicholas James Lawrence, Buckingham (GB)

(73) Assignee: Mechadyne PLC, Kirtlington (GB)

( * ) Notice: Subject to any disclaimer, the term of this patent is extended or adjusted under 35 U.S.C. 154(b) by 184 days.

(21) Appl. No.: 12/446,942

(22) PCT Filed: Oct. 26, 2007

(86) PCT No.: PCT/GB2007/050657

§ 371 (c)(1),
(2), (4) Date: Apr. 23, 2009

(87) PCT Pub. No.: WO2008/056181

PCT Pub. Date: May 15, 2008

(65) Prior Publication Data

US 2010/0288229 A1 Nov. 18, 2010

(30) Foreign Application Priority Data

Nov. 6, 2006 (GB) ..... 0622057.8

(51) Int. Cl.
*F01L 1/344* (2006.01)

(52) U.S. Cl. ..... 123/90.15; 123/90.17; 123/321

(58) Field of Classification Search .... 123/90.15–90.18, 123/321
See application file for complete search history.

(56) References Cited

U.S. PATENT DOCUMENTS

| | | | | |
|---|---|---|---|---|
| 4,522,085 | A * | 6/1985 | Kane | 74/568 R |
| 4,805,571 | A | 2/1989 | Humphrey | |
| 5,099,805 | A * | 3/1992 | Ingalls | 123/90.15 |
| 5,253,622 | A * | 10/1993 | Bornstein et al. | 123/90.17 |
| 5,809,954 | A * | 9/1998 | Devine et al. | 123/90.17 |
| 7,036,483 | B2 * | 5/2006 | El Tahry et al. | 123/316 |
| 2004/0055548 | A1 * | 3/2004 | Williams | 123/90.15 |
| 2005/0034694 | A1 * | 2/2005 | Williams | 123/90.17 |

FOREIGN PATENT DOCUMENTS

| | | | |
|---|---|---|---|
| DE | 3934848 | A1 | 4/1991 |
| DE | 10038916 | A1 | 2/2002 |
| EP | 0818612 | A | 1/1998 |
| GB | 448086 | A | 6/1936 |
| GB | 767645 | A | 2/1957 |

* cited by examiner

*Primary Examiner* — Erick Solis
(74) *Attorney, Agent, or Firm* — Chernoff, Vilhauer, McClung & Stenzel

(57) ABSTRACT

An internal combustion engine has intake (20) and exhaust (22) poppet valves, a first and a second set of cam lobes (64) for operating the intake and exhaust poppet valves (20,22) respectively, and a third set of cam lobes (68) for producing an additional selectable valve event in order to allow the engine to operate as a compression brake. The third set of cam lobes (68) and at least one of the first and second set of cam lobes (64) are rotatable relative to one another and form part of an assembled camshaft (60) so as to be rotatable about a common axis. A phasing system (50) acts on the assembled camshaft (60) to allow the phase of the third set of cam lobes (68) to be changed relative to the engine crankshaft.

8 Claims, 6 Drawing Sheets

VALVE MECHANISM FOR AN ENGINE

This is a national stage application filed under 35 USC 371 based on International Application No. PCT/GB2007/050657 filed Oct. 26, 2007, and claims priority under 35 USC 119 of United Kingdom Patent Application No. 0622057.8 filed Nov. 6, 2006.

FIELD OF THE INVENTION

The present invention relates to an engine having a valve mechanism which allows compression braking.

BACKGROUND OF THE INVENTION

It is known for engines, especially diesel engines designed for heavy duty applications, to be fitted with a compression braking system. The compression braking system allows large amounts of energy to be dissipated by the engine by introducing an additional exhaust valve opening close to Top Dead Centre (TDC) of the compression stroke such that the compressed gas is released into the exhaust system. The engine is therefore operating as an air pump and no fuel is added during this mode of its operation. Often a further exhaust valve opening occurs during the intake stroke when the compression brake is operated in order to reduce intake pumping losses.

Methods for producing an additional exhaust event that is selectable in order to allow a compression braking mode of operation are well known in the prior art (e.g. U.S. Pat. No. 3,220,392). Typically conventional compression brake systems are either on or off, and as a result there is no facility for changing the amount of energy that is dissipated by each cylinder. Some engines do however operate a compression brake system on different groups of cylinders in order to provide some control of the braking effort.

An alternative method for changing the effect of a compression brake would be to change the timing of the additional exhaust valve opening. Advancing the timing of the additional valve opening to a position some way before TDC will release the gas from the cylinder before it has been fully compressed, and this will reduce the braking effect. Reducing the braking effect will also reduce the noise generated as the compressed gas is released from the cylinder—the use of compression brakes is banned in some areas at night due to the noise they make.

There are also a number of engine combustion strategies that have been proposed which use additional valve openings, for example an additional exhaust opening in the intake stroke may be used to generate internal EGR (e.g. US2006102121).

As a secondary valve opening to modify the combustion process and a compression brake are never required at the same time, it would be advantageous to use a single system to produce both types of secondary valve lift.

OBJECT OF THE INVENTION

The present invention seeks to provide a valve mechanism producing a secondary selectable valve lift the timing of which may be varied such that it is suitable for modulating the operation of a compression brake or as a means to modify the combustion cycle of the engine.

SUMMARY OF THE INVENTION

According to the present invention, there is provided an internal combustion engine having intake and exhaust poppet valves, a first and a second set of cam lobes for operating the intake and exhaust poppet valves, respectively, a third set of cam lobes for producing an additional selectable valve event, the third set of cam lobes and at least one of the first and second set of cam lobes being rotatable relative to one another and forming part of an assembled camshaft so as to be rotatable about a common axis, and a phasing system acting on the assembled camshaft to allow the phase of the third set of cam lobes to be changed relative to the engine crankshaft.

The term SCP camshaft is used herein to denote such an assembled camshaft that comprises a shaft mounted within, and rotatable relative, to an outer tube. A first group of cam lobes is mounted for rotation with the outer tube while a second group is rotatable relative the outer tube and connected for rotation with the inner shaft by means of pins that pass through circumferentially elongated slots in the outer tube. Such camshafts are known per se, an example being described in EP 1696107.

The preferred embodiment of the invention utilises a conventional rocker system to provide the additional selectable valve lift, the rocker being fitted with a hydraulic element that can be inflated by a selectable oil feed. The additional lift may therefore be selected by turning on the switched oil feed and deselected by turning off the oil feed.

An important aspect of a compression brake is that there are extremely high pressures in the cylinder when the exhaust valve is opened, and this results in a high instantaneous camshaft torque as the valve opens. Unlike the normal operation of the engine valves which creates both positive and negative cam torques of similar magnitudes as they open and close, there is not a correspondingly large torque spike when the valve closes because there is no pressure inside the cylinder forcing the valve onto its seat. As a result, the compression brake lobe has a strong retarding characteristic when the brake is in operation, and this means that it is difficult to design a phasing system that would have sufficient torque to maintain the timing of the secondary lift lobe at an advanced timing.

The preferred embodiment of the invention utilises the fact that the compression brake valve event is produced by an additional selectable rocker in order to change the timing of the event. There is no difficulty in providing a cam phasing system that can change the timing of the additional lift lobe when the system is deselected, and so a phasing system is used that has a positive lock at both extremes of its travel.

The timing may therefore be adjusted whilst the additional lift is deselected and locked into the appropriate position. The additional lift may then be selected and the high lobe torques will be unable to affect the phasing system position because the torque will be transmitted by the locking system.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
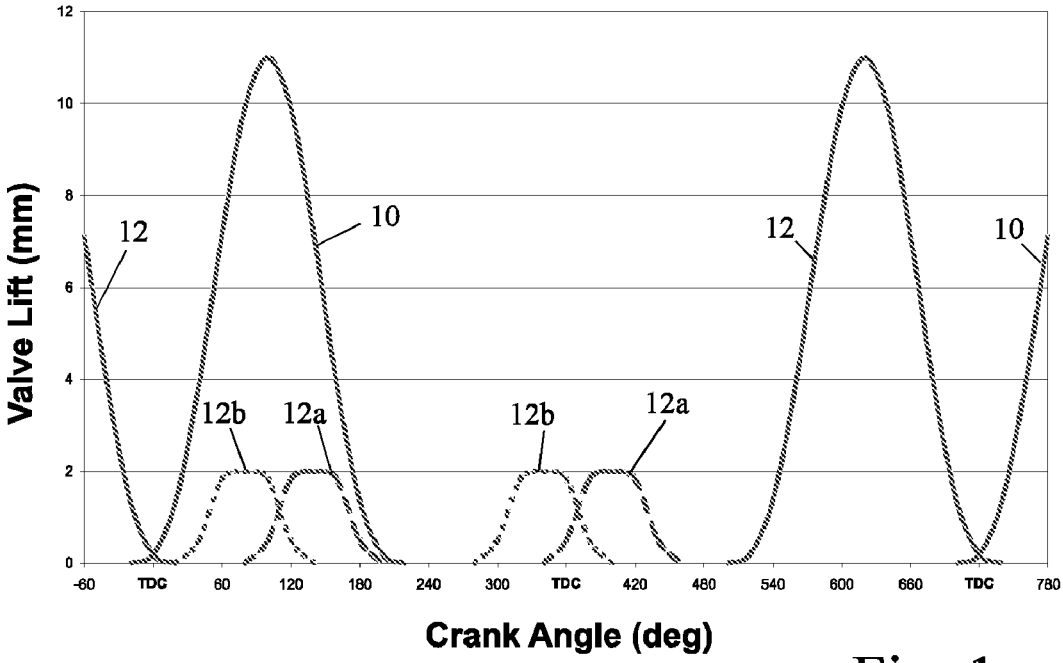
FIG. 1 is a graph of valve lift versus crank angle demonstrating brake timing control.

FIG. 1 shows how a compression brake event may have its timing modified in order to control the amount of engine braking generated. The compression brake lift shown also has a second opening during the intake stroke to improve volumetric efficiency.

The inlet valve events are designated 10 and the exhaust valve events 12. Two alternative positions of the selectable secondary exhaust openings are shown by the broken line 12*a* and the dotted line 12*b*. The broken line curve 12*a* has a valve lift that commences just before TDC and this will produce the maximum amount of braking. The dotted lift curve 12*b*, on the other hand, opens significantly before TDC and will therefore produce a reduced braking effort.

Figure 2:
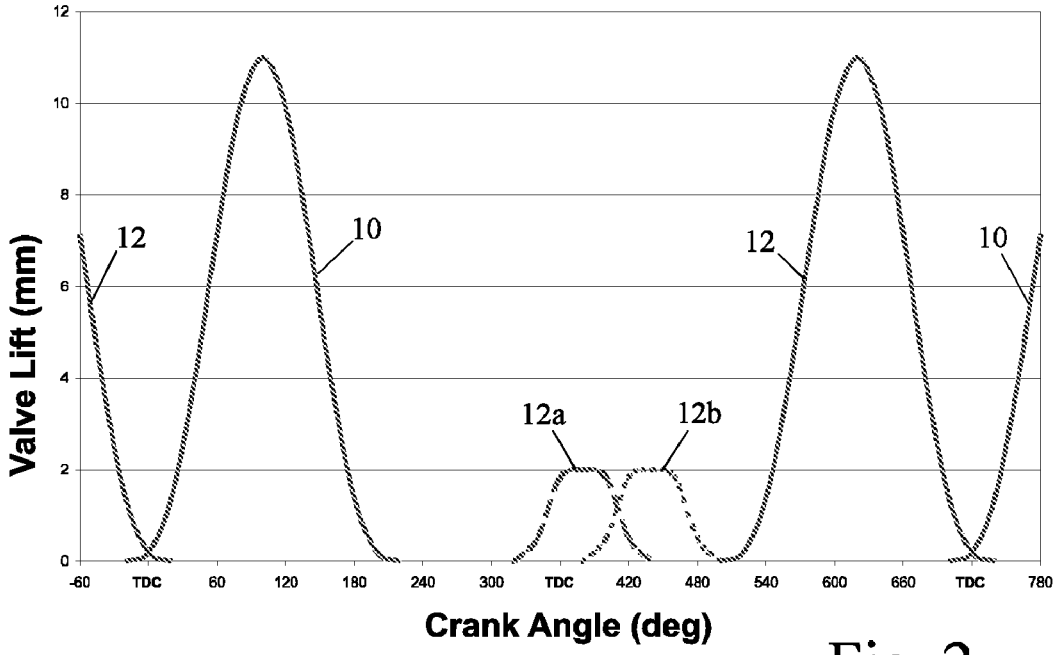
FIG. 2 is a similar graph showing early exhaust valve opening setting.

FIG. 2 shows an alternative system configuration which has the compression brake event 12*a* commencing just before TDC with an alternative event timing 12*b* that commences after TDC and acts as an early exhaust valve opening event to optimise the combustion process within the engine.

Figure 3:
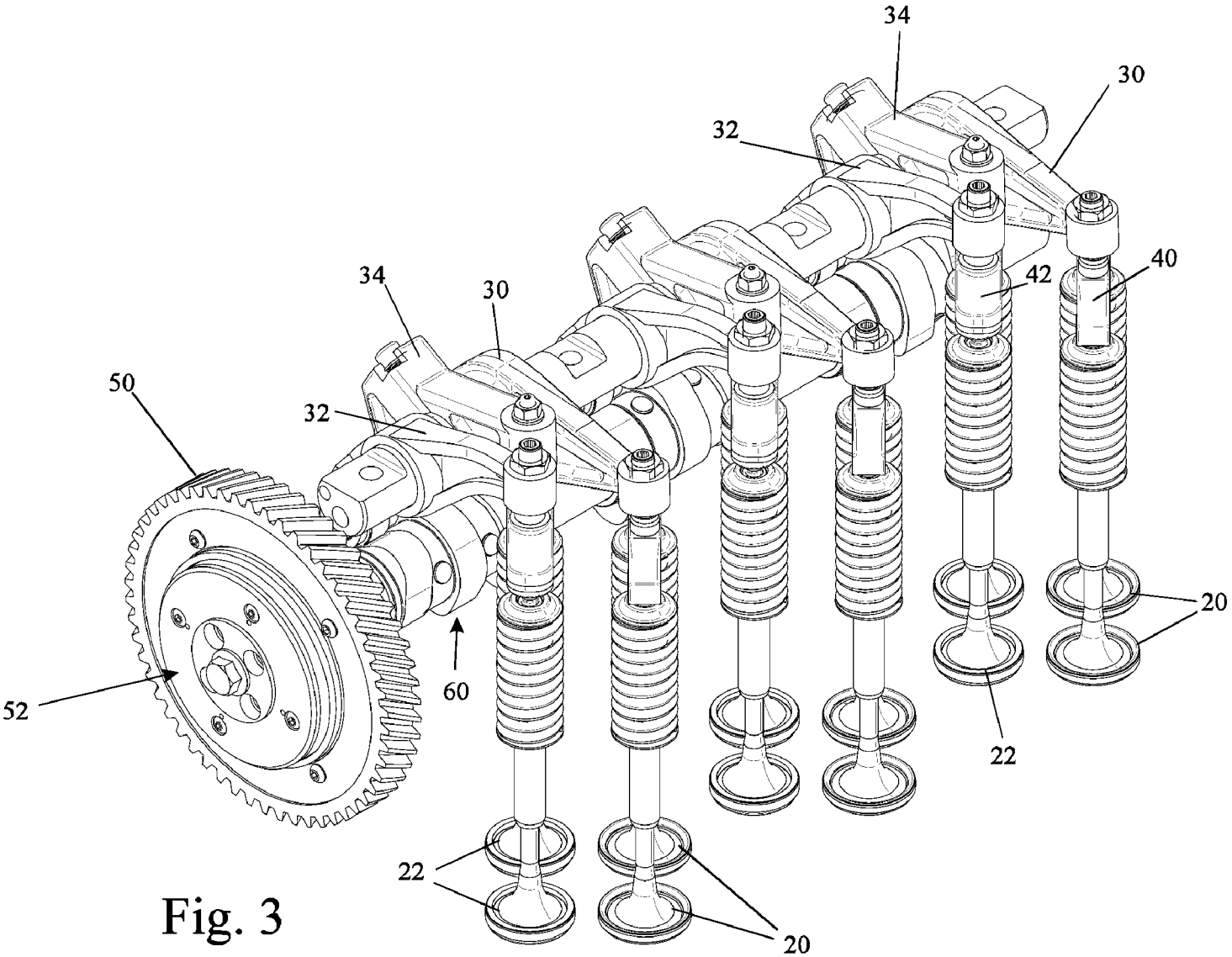
FIG. 3 is an isometric view of a valve mechanism of an engine embodying the present invention.

FIG. 3 shows the layout of a system configured to suit a three-cylinder engine. Each pair of intake valves 20 or exhaust valves 22 is operated by a respective rocker 30, 32 via a respective bridge piece 40, 42 that acts on the tip of both valves in the pair. A group of three rockers 30, 32 and 34 is provided for each cylinder, the two outer rockers 30 and 32 are used to generate the conventional intake and exhaust valve lift events of the intake and exhaust valves 20 and 22, while the central rocker 34 of the three is used to generate the selectable additional exhaust valve lift for compression braking.

The system utilises an assembled SCP camshaft 60, shown more clearly in FIGS. 5 to 10. In the described embodiment, the first set of cams of the SCP camshaft, i.e. the cams fast in rotation with the outer tube, operates the main intake and exhaust rockers 30 and 32, while the second set of cams which rotates with the inner shaft acts on the rocker 34 for operating the selectable exhaust lift.

Figure 4:
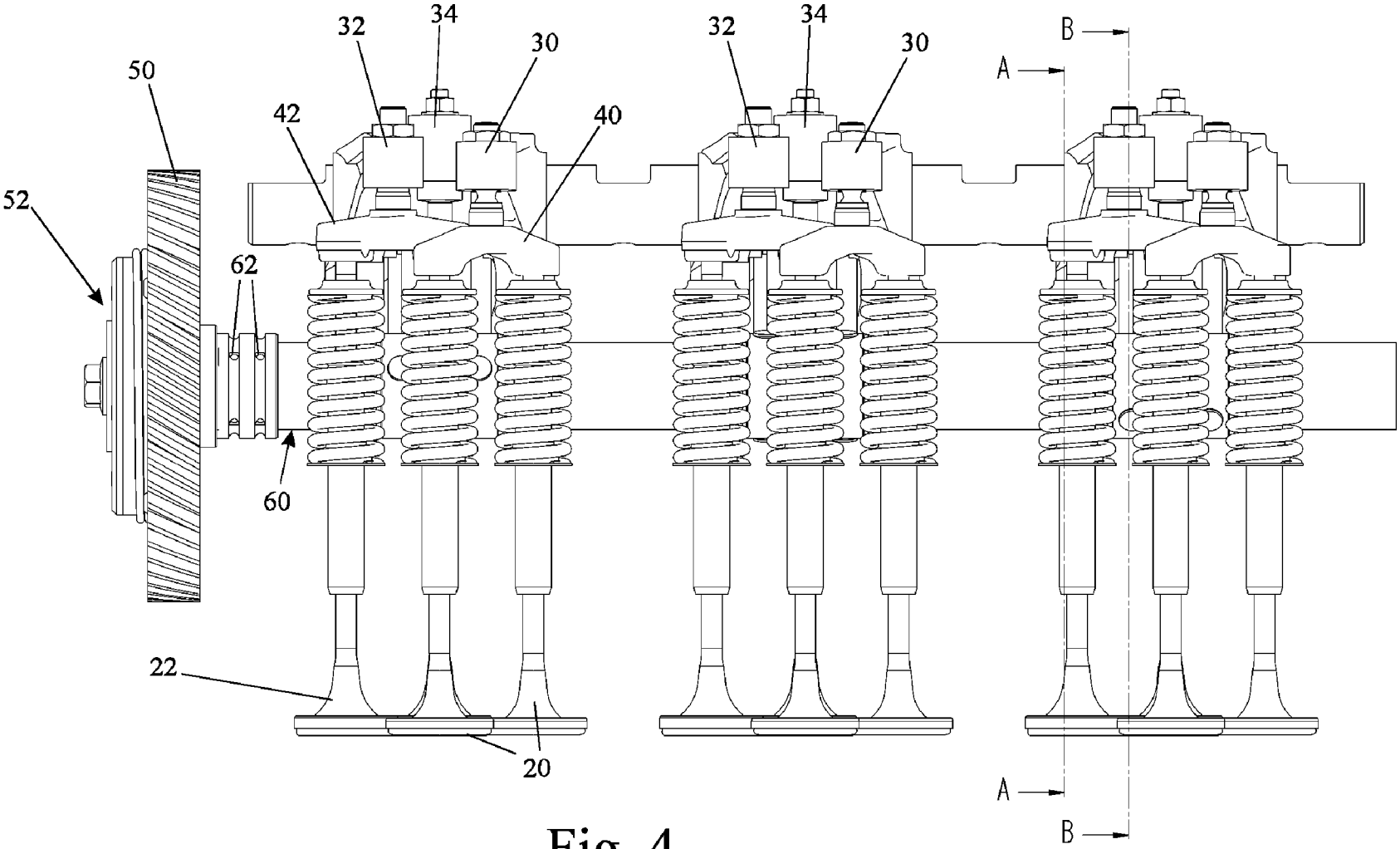
FIG. 4 is a side view of the valve mechanism shown in FIG. 3.

FIG. 4 shows further the arrangement of the system, which is fitted with a camshaft phasing system 52, also referred to herein as a phaser, packaged inside the drive gear 50 for changing the timing of the secondary exhaust lift relative to the crankshaft. The front of the SCP camshaft 60 has drillings 62 that supply oil to the camshaft phaser 52 in order to advance or retard the timing of the moving cam lobes.

Figure 5:
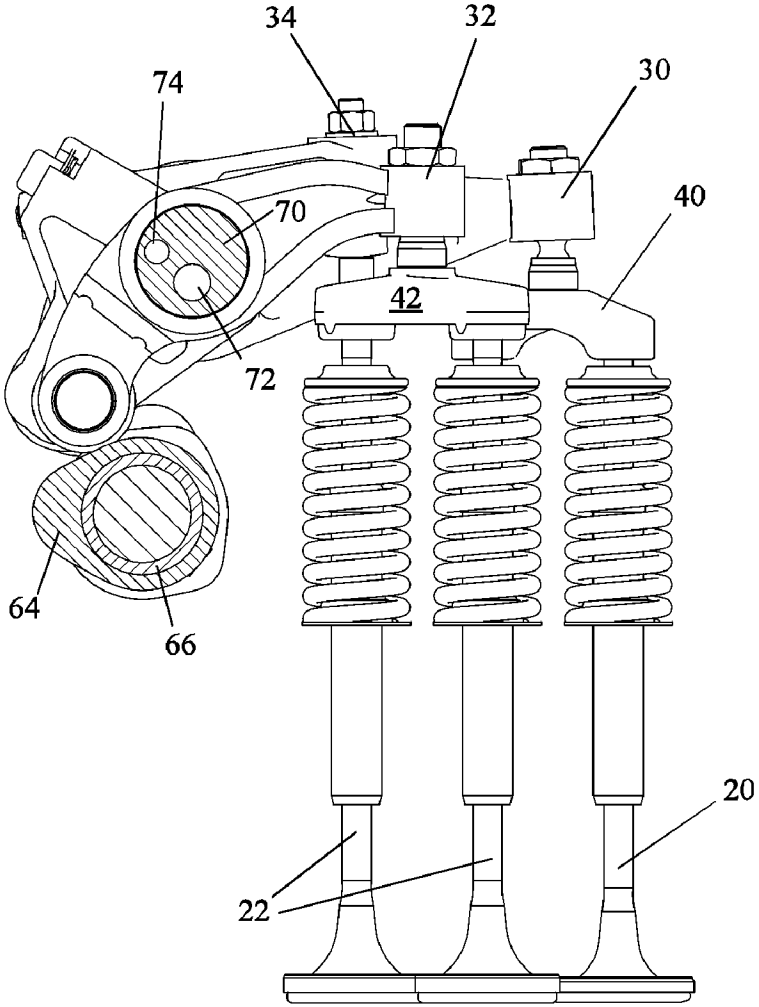
FIG. 5 is a section taken in the plane A-A in FIG. 4.

FIG. 5, which is a section on the line A-A in FIG. 4, shows the rocker system for producing the fixed exhaust valve opening. The cam lobe 64 is fitted to the outer tube 66 of the camshaft and the rocker acts on the centre of the bridge piece in order to open both exhaust valves.

Figure 6:
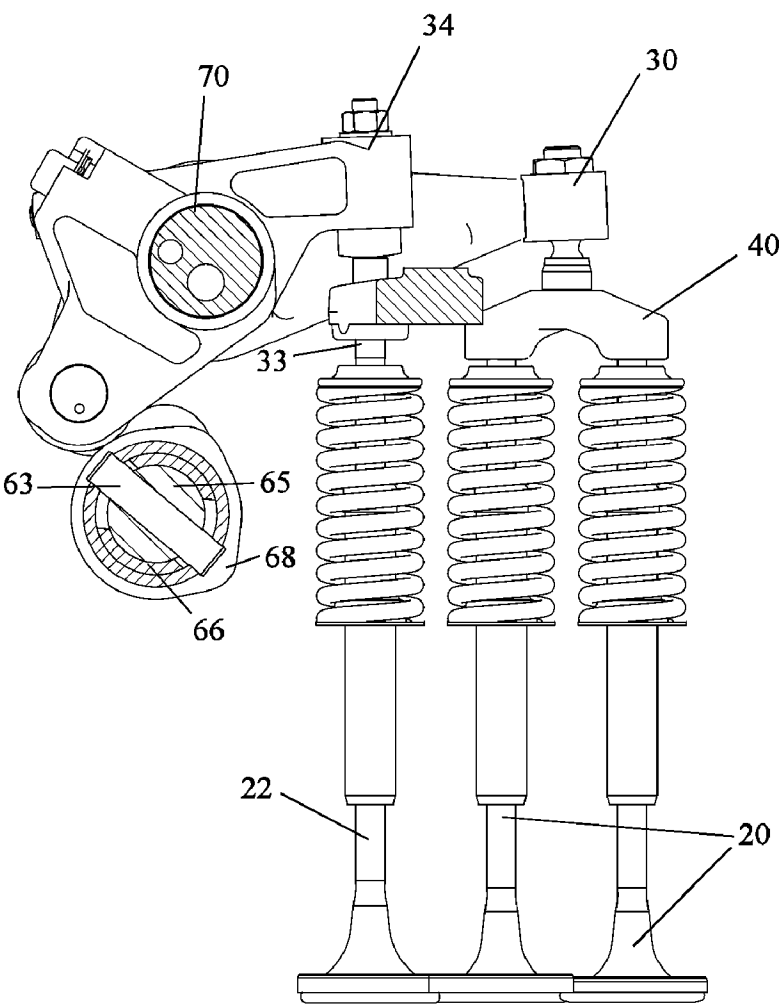
FIG. 6 is a section taken in the plane B-B in FIG. 4.

FIG. 6, which is a section on the line B-B in FIG. 4, shows the rocker system for producing the additional, selectable, exhaust lift. The cam lobe 68 operating the rocker 34 is driven by a pair of pins 63 connecting it to the inner drive shaft 65, only one of the pins 63 being shown in the section of FIG. 6. Rather than acting on the centre of the bridge piece 42, the rocker 34 acts upon the tip of one of the exhaust valves 22 via an insert 33 in the bridge piece 42. Thus the additional lift affects only one exhaust valve.

In both sections it can be seen that the rocker shaft 70 has two oil drillings 72 and 74. The larger of the drillings 72 supplies oil to all of the rocker bearings along the shaft whilst the second drilling 74 is a switched oil feed to activate the additional exhaust valve lift. The rocker 34 has a hydraulic element that inflates when this oil feed is pressurised and deflates when the oil feed is switched off, disabling the additional valve lift. Such selectable rockers are known from the prior art and their operation need not be described in detail.

When the secondary exhaust valve lift is operated in order for the engine to act as a compression brake, the exhaust valve 22 has to be opened when there is a high pressure in the cylinder of the engine, and this causes a very high camshaft torque spike at the point of valve opening. This results in the cam lobe having a mean torque that is significantly biased in a retarding direction because there is no corresponding advancing torque spike when the valve closes.

As a result, it is not practical to design a camshaft phaser with sufficient torque capacity to overcome the retarding characteristic of the cam lobes for the selectable lift. It is however possible to change the timing of the cam lobes with a phaser of quite modest torque output whilst the additional lift is deactivated.

Figure 7:
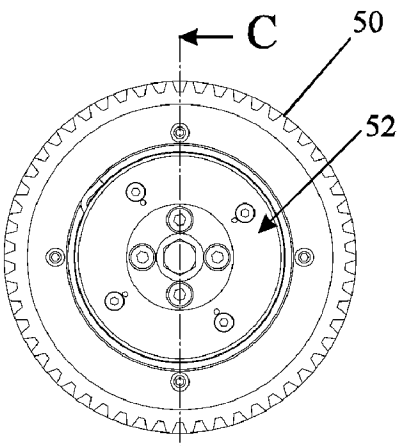
FIG. 7 is a front view of the phasing system in a first position.
Figure 9:
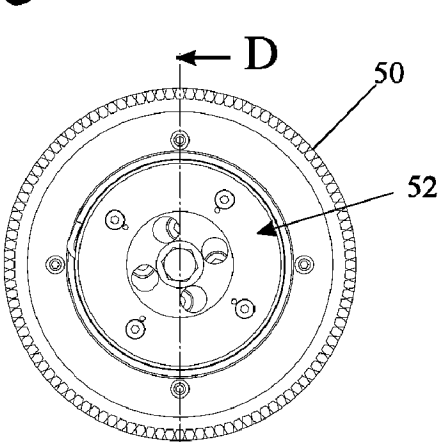
FIG. 9 is a front view of the phasing system in a second position.

FIG. 7 shows the phaser design for controlling the timing of the additional exhaust lift. The phaser 52 is a vane type design that is able to lock in both extremes of its travel such that it cannot be moved by camshaft drive torques in excess of its own torque capacity. The phaser may be moved when the additional exhaust valve lift is deactivated, and the additional lift may then be activated by the engine management system once the phaser is locked in the correct position.

Figure 8:
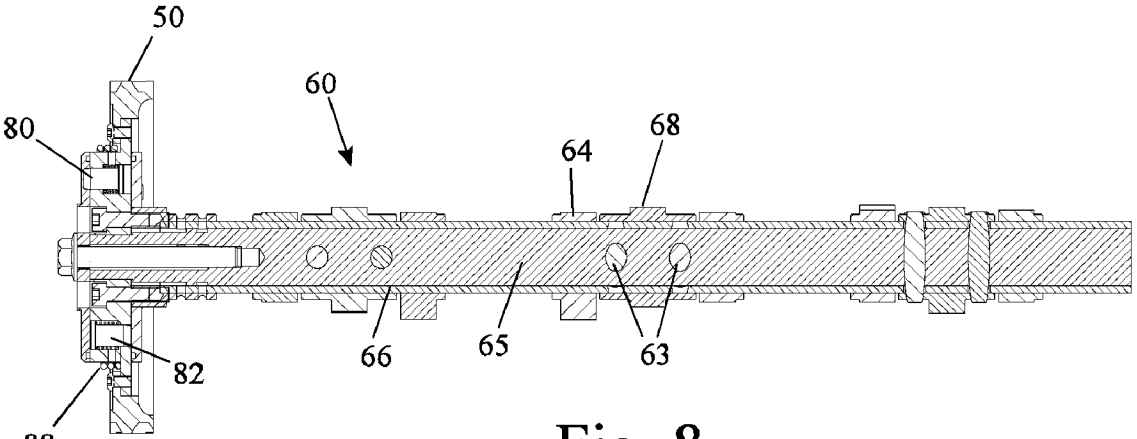
FIG. 8 is a section in the plane C-C in FIG. 7.
Figure 10:
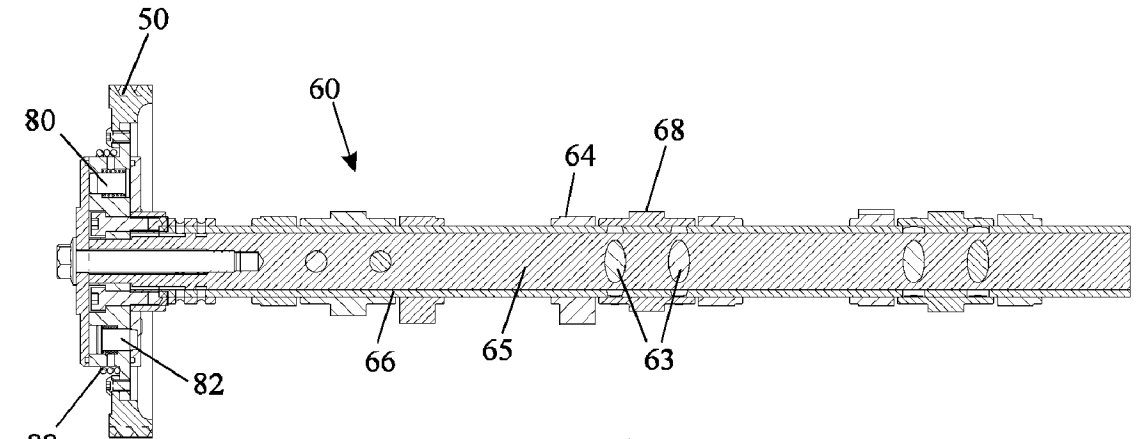
FIG. 10 is a section in the plane D-D in FIG. 9.

The two locking pins may be seen in the sectional views of FIGS. 8 and 10, in which FIG. 8 shows the phaser 52 and camshaft in an advanced position whilst FIG. 10 shows the phaser and camshaft in a retarded position. In the advanced setting it can be seen that a first locking pin 80 (shown uppermost in FIGS. 8 and 10) is engaged in the front plate of the phaser 52 whilst a second locking pin 82 is disengaged. Conversely, in the retarded setting shown in FIG. 10, it can be seen that the first locking pin 80 is disengaged whilst the second locking pin 82 is engaged in the rear plate of the phaser 52.

Figure 11:
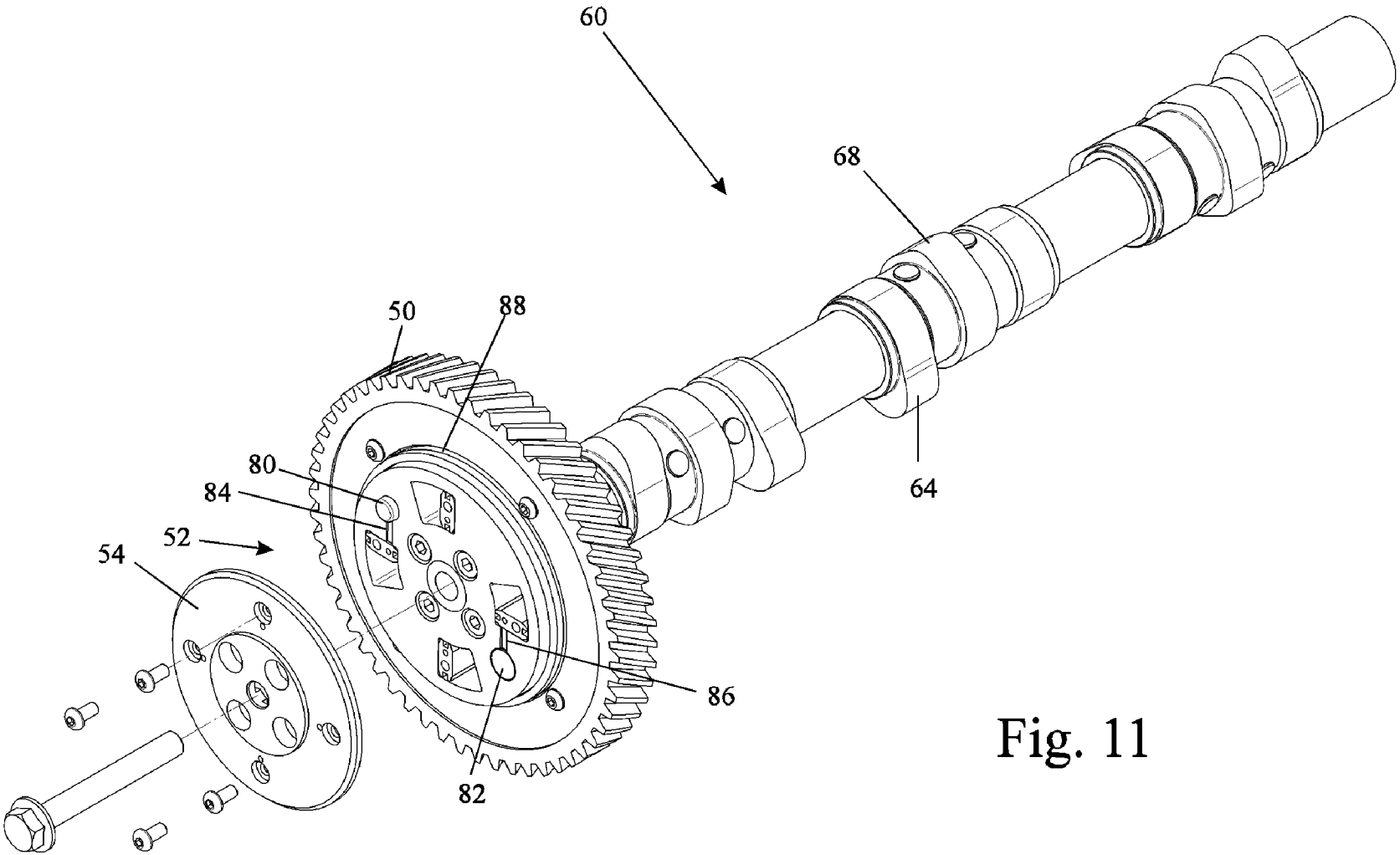
FIG. 11 is a partially exploded view of the phasing system and camshaft.

Each locking pin has a return spring that acts to disengage the pin and the pin is engaged by oil pressure supplied from an adjacent vane cavity. The oil supply to the pins is shown in the exploded view of FIG. 11 where the phaser is shown in its advanced setting and the locking pin 80 that engages in the front plate 54 is extended. If the phaser is to be moved to its retarded position, the oil pressure needs to act on the side of the vanes that are contacting the cavity walls in FIG. 11. Pressurising this side of the vanes will feed oil to the locking pin 80 engaged in the front plate 54 by way of a groove 84 to help it to disengage and will also feed oil by way of a groove 86 to the locking pin 82 in order to engage it in the rear plate as soon as the phaser reaches its retarded position. Two similar oil connection grooves are provided in the rear of the cavity plate to move both locking pins in the opposite directions.

It would in principle be possible to provide the phaser with only one lock in order to hold it in an advanced position, as the retarding nature of the cam torque from the selectable lift will not attempt to drive the phaser away from its most retarded position.

It can be seen in FIGS. 7 to 11 that the phaser may be fitted with a torque spring 88 to alter its operating characteristic.

This may be used to ensure that the phaser has an equal operating speed in both the advancing and retarding directions, or it may be used to replace one of the phaser oil feeds. As the phaser is only required to move between its two locked positions, it would be possible to construct a phaser with a spring return to its most retarded position, and use oil pressure to advance the timing against the action of the spring. An oil supply for retarding the phaser would therefore not be necessary.

The described preferred embodiment of the invention offers the following advantages when compared to existing designs:

It utilises the existing compression brake system to enable a new operating strategy.

It allows a conventional type of phasing system to be used to change the timing of the compression brake lobe.

It isolates the hydraulic part of the phasing system from the high cam lobe torques that are generally produced by an exhaust brake.

The invention claimed is:

1. An internal combustion engine having intake and exhaust poppet valves, a first and a second set of cam lobes for operating the intake and exhaust poppet valves, respectively, a third set of cam lobes for producing an additional selectable valve event, the third set of cam lobes and at least one of the first and second set of cam lobes being rotatable relative to one another and forming part of an assembled camshaft so as to be rotatable about a common axis, and a phasing system acting on the assembled camshaft to allow the phase of the third set of cam lobes to be changed relative to the engine crankshaft.

2. An internal combustion engine as claimed in claim 1, wherein the phasing system is operative to vary the timing of the selectable valve event relative to the crankshaft in order to regulate power dissipated by compression braking.

3. An internal combustion engine as claimed in claim 1, wherein the phasing system is operative to vary the timing of the selectable valve lift relative to the intake and exhaust valve events to regulate the combustion cycle within engine cylinders.

4. An internal combustion engine as claimed in claim 1, wherein the phasing system has two stable operating positions and may only change positions while the additional valve events are deselected.

5. An internal combustion engine as claimed in claim 4, having a phasing system that is lockable in at least one of the operating positions in order to isolate the phaser from the torque requirement of the selectable valve events.

6. An internal combustion engine as claimed in claim 5, wherein an additional valve event may only be selected when the phasing system is in a locked operating position.

7. An internal combustion engine as claimed in claim 1, wherein the phasing system is biased by a spring towards one of its operating positions.

8. An internal combustion engine as claimed in claim 7, wherein the phasing system is moved towards one of its operating positions under the action of the spring and hydraulic pressure is used to move the phasing system to the second operating position against the action of the spring.

* * * * *